US011288966B2

(12) United States Patent
Uchisasai et al.

(10) Patent No.: US 11,288,966 B2
(45) Date of Patent: Mar. 29, 2022

(54) INFORMATION NOTIFICATION APPARATUS OF STRADDLE TYPE VEHICLE, STRADDLE TYPE VEHICLE, AND INFORMATION NOTIFICATION METHOD

(71) Applicant: HONDA MOTOR CO., LTD., Tokyo (JP)

(72) Inventors: Hiroaki Uchisasai, Wako (JP); Hiroshi Maeda, Wako (JP); Marika Mochizuki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/015,435

(22) Filed: Sep. 9, 2020

(65) Prior Publication Data

US 2020/0410863 A1 Dec. 31, 2020

Related U.S. Application Data

(63) Continuation of application No. PCT/JP2018/010038, filed on Mar. 14, 2018.

(51) Int. Cl.
*G08G 1/16* (2006.01)
*G08G 1/0962* (2006.01)

(52) U.S. Cl.
CPC ..... *G08G 1/166* (2013.01); *G08G 1/0962* (2013.01); *G08G 1/167* (2013.01)

(58) Field of Classification Search
None
See application file for complete search history.

(56) References Cited

U.S. PATENT DOCUMENTS 5,450,057 A * 9/1995 Watanabe ..... B60Q 9/00 340/435
5,777,563 A * 7/1998 Minissale ..... B60Q 9/006 340/903
8,130,092 B2 3/2012 Shiraki
(Continued)

FOREIGN PATENT DOCUMENTS

DE 102012018099 A1 * 3/2014 ..... G01S 13/931
JP 2007147440 A 6/2007
(Continued)

OTHER PUBLICATIONS

International Search Report for PCT/JP2018/010038 dated Jun. 19, 2018.
IPRP for PCT/JP2018/010038 dated Jan. 30, 2020.

*Primary Examiner* — Muhammad Adnan
(74) *Attorney, Agent, or Firm* — Thomas | Horstemeyer, LLP

(57) ABSTRACT

An information notification apparatus is mounted on a straddle type vehicle and is capable of performing information notification mutually with a vehicle existing on the periphery of the straddle type vehicle. The information notification apparatus comprises: a plurality of detection units, having detection areas of different characteristics, configured to detect relative information representing a relative relationship with the vehicle; and a detection control unit configured to control, based on vehicle speed information of the straddle type vehicle, switching of a detection unit used for the information notification in the plurality of detection units.

10 Claims, 8 Drawing Sheets

(56) References Cited

U.S. PATENT DOCUMENTS

| | | | | |
|---|---|---|---|---|
| 8,310,353 | B2 * | 11/2012 | Hinninger | B60Q 9/008 340/435 |
| 8,552,848 | B2 * | 10/2013 | Rao | B60Q 9/006 340/435 |
| 8,781,721 | B2 * | 7/2014 | Dowdall | B60R 21/00 701/301 |
| 9,050,930 | B2 * | 6/2015 | Walsh | G08G 1/166 |
| 9,599,710 | B2 * | 3/2017 | Matsuura | G08G 1/167 |
| 9,697,733 | B1 * | 7/2017 | Penilla | B60L 58/12 |
| 9,714,032 | B2 * | 7/2017 | Kida | B60W 10/18 |
| 9,865,170 | B2 * | 1/2018 | Loce | G08G 1/166 |
| 10,073,456 | B2 * | 9/2018 | Mudalige | G05D 1/0214 |
| 10,099,610 | B2 * | 10/2018 | Schofield | G08G 1/163 |
| 10,380,894 | B2 | 8/2019 | Sawato et al. | |
| 10,451,722 | B2 * | 10/2019 | Tanaka | G01S 15/582 |
| 10,501,085 | B2 * | 12/2019 | Luders | G05D 1/0088 |
| 10,589,660 | B2 * | 3/2020 | Kimura | H01L 27/1464 |
| 10,625,745 | B1 * | 4/2020 | Tremblay | G06K 9/00845 |
| 10,640,126 | B2 * | 5/2020 | Watkins | B60Q 1/50 |
| 10,717,436 | B2 * | 7/2020 | Foltin | G01S 13/931 |
| 10,846,833 | B2 * | 11/2020 | Alahmar | G06T 5/008 |
| 11,059,478 | B2 * | 7/2021 | Sims, III | G05D 1/0088 |
| 11,126,179 | B2 * | 9/2021 | Karasev | G05D 1/0246 |
| 11,164,264 | B2 * | 11/2021 | Shalev-Shwartz | G08G 1/163 |
| 2008/0077327 | A1 * | 3/2008 | Harris | G01S 13/931 701/301 |
| 2008/0266052 | A1 * | 10/2008 | Schmid | G01S 13/931 340/5.1 |
| 2009/0009306 | A1 * | 1/2009 | Magane | G01S 15/931 340/435 |
| 2009/0212934 | A1 * | 8/2009 | Shiraki | G08G 1/163 340/466 |
| 2010/0246327 | A1 * | 9/2010 | Yoshida | G01S 7/52003 367/103 |
| 2011/0133917 | A1 * | 6/2011 | Zeng | G06K 9/6293 340/436 |
| 2014/0222368 | A1 * | 8/2014 | Kasama | G01S 7/4808 702/149 |
| 2016/0077202 | A1 * | 3/2016 | Hirvonen | A61H 3/061 342/25 R |
| 2016/0148514 | A1 * | 5/2016 | Iwami | B60W 30/06 340/932.2 |
| 2016/0253905 | A1 * | 9/2016 | Sawato | G08G 1/163 340/902 |

FOREIGN PATENT DOCUMENTS

| | | | |
|---|---|---|---|
| JP | 2009200907 | A | 9/2009 |
| JP | 2010198100 | A | 9/2010 |
| WO | 2007138713 | A1 | 12/2007 |
| WO | 2015064745 | A1 | 5/2015 |
| WO | 2019176028 | A1 | 9/2019 |

* cited by examiner

INFORMATION NOTIFICATION APPARATUS OF STRADDLE TYPE VEHICLE, STRADDLE TYPE VEHICLE, AND INFORMATION NOTIFICATION METHOD

CROSS-REFERENCE TO RELATED APPLICATION

This application is a continuation of International Patent Application No. PCT/JP2018/010038 filed on Mar. 14, 2018, the entire disclosures of which is incorporated herein by reference.

BACKGROUND OF THE INVENTION

Field of the Invention

The present invention relates to an information notification apparatus of a straddle type vehicle, a straddle type vehicle, and an information notification method.

Description of the Related Art

PTL 1 discloses a technique of communicating with another vehicle by a communication device mounted on a self-vehicle and notifying approach information of the other vehicle.

CITATION LIST

Patent Literature

PTL 1: International Publication No. 2015-064745

In the arrangement of PTL 1, however, since communication via a network is performed, data communication may delay depending on loads on the network. Additionally, to instantaneously detect the degree of alarming around the straddle type vehicle that is the self-vehicle, it is efficient to switch a detection unit used for information notification based on the vehicle speed information of the self-vehicle.

SUMMARY OF THE INVENTION

The present invention provides an information notification technique capable of controlling, concerning a plurality of detection units arranged in a straddle type vehicle, switching of a detection unit (detection units) used for information notification in the plurality of detection units based on the vehicle speed information of the straddle type vehicle.

An information notification apparatus according to one aspect of the present invention is an information notification apparatus mounted on a straddle type vehicle and capable of performing information notification mutually with a vehicle existing on the periphery of the straddle type vehicle, comprising: a plurality of detection units, having detection areas of different characteristics set based on input from an information terminal device, configured to detect relative information representing a relative relationship with the vehicle; a detection control unit configured to control, based on vehicle speed information of the straddle type vehicle, switching of detection units used for the information notification in the plurality of detection units; and a display unit, including a notification display unit, configured to notify a driver of existence information representing existence of the vehicle in a detection area.

ADVANTAGEOUS EFFECTS OF INVENTION

According to the present invention, it is possible to control switching of a detection unit (detection units) used for information notification in a plurality of detection units based on the vehicle speed information of a straddle type vehicle.

Other features and advantages of the present invention will be apparent from the following description taken in conjunction with the accompanying drawings. Note that the same reference numerals denote the same or like components throughout the accompanying drawings.

BRIEF DESCRIPTION OF THE DRAWINGS

The accompanying drawings, which are incorporated in and constitute a part of the specification, illustrate embodiments of the invention and, together with the description, serve to explain principles of the invention.

DESCRIPTION OF THE EMBODIMENTS

An embodiment of the present invention will now be described with reference to the accompanying drawings. Constituent elements described in this embodiment are merely examples, and are not limited by the following embodiment.

(Arrangement of Motorcycle (Straddle Type Vehicle))

Figure 1:
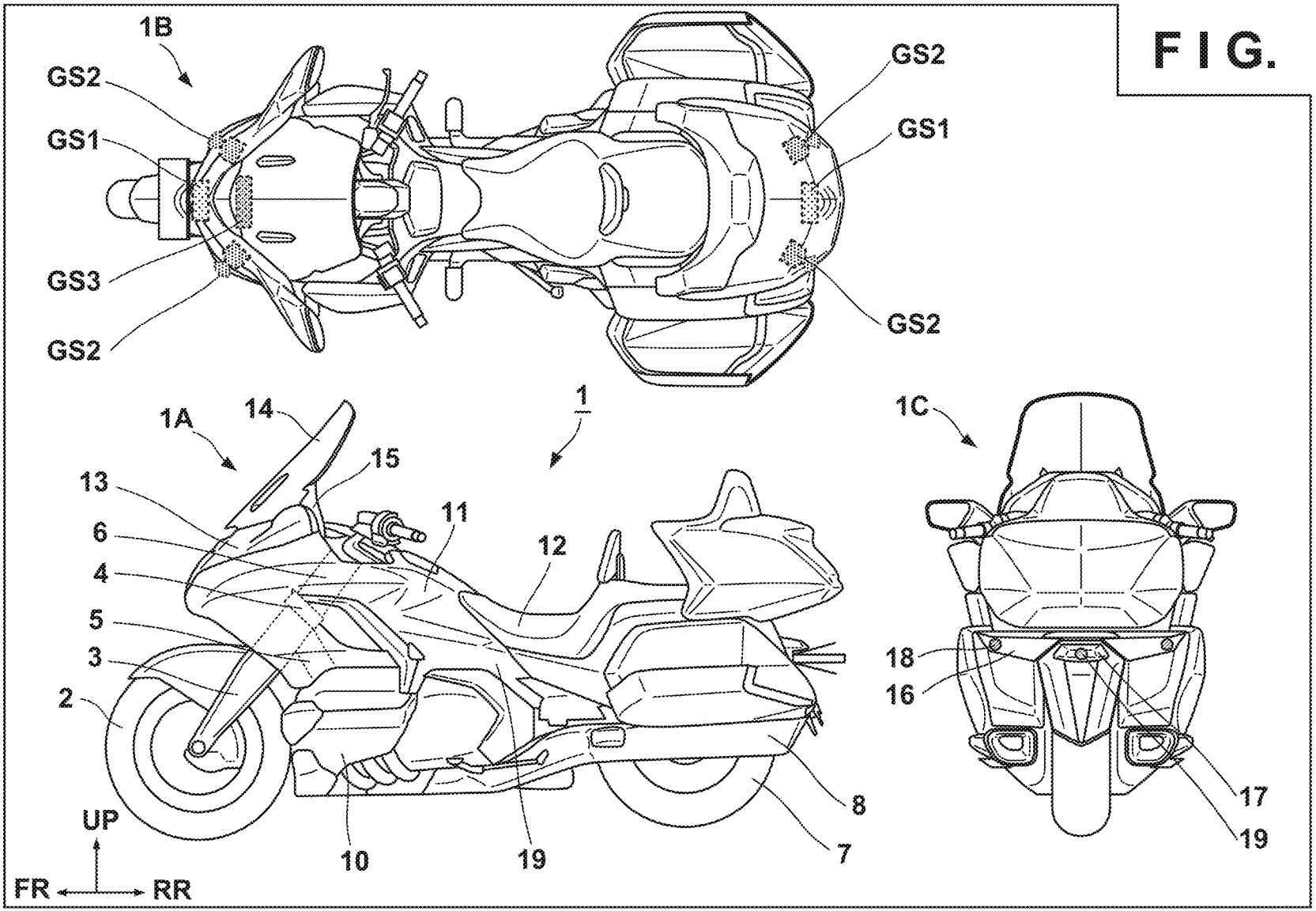
FIG. 1 is a view showing the outer appearance configuration of a motorcycle according to an embodiment.

FIG. 1 is a view showing the outer appearance configuration of a motorcycle (straddle type vehicle 1) according to the embodiment of the present invention. 1A in FIG. 1 is a left side view of the straddle type vehicle 1, 1B in FIG. 1 is a top view of the straddle type vehicle 1, and 1C in FIG. 1 is a rear view of the straddle type vehicle 1. In the straddle type vehicle 1, a front wheel 2 is axially supported by the lower end portions of a pair of left and right front forks 3. The upper portions of the left and right front forks 3 are pivotally steerably supported by a head pipe 6 at the front end portion of a vehicle body frame 5 via a steering stem 4. A rear wheel 7 of the straddle type vehicle 1 is axially supported by the rear end portion of an arm 8 extending to the front and rear sides on the lower side of the vehicle body rear portion. The front end portion of the arm 8 is pivotally supported at the intermediate portion of the vehicle body frame 5 in the front-and-rear direction to be swingable in the vertical direction.

An engine (internal combustion engine) 10 that is the motor of the straddle type vehicle 1 is mounted on the vehicle body frame 5. A fuel tank 11 is arranged above the engine 10, and a seat 12 on which the occupant (driver) of the straddle type vehicle 1 sits is arranged on the rear side of the fuel tank 11. A front cowl 13 supported by the vehicle body frame 5 is attached to the vehicle body front portion. A screen 14 is provided on the front upper side of the front cowl 13. A display device 15 is arranged inside the front cowl 13. Reference numeral 16 denotes a tail turn signal of the straddle type vehicle 1; and 17, a tail light of the straddle type vehicle 1.

In the straddle type vehicle 1, a radar GS1, a sonar GS2, and a communication information detection unit GS3 that acquires outside information by communication in a road traffic system C-ITS are arranged as an outside information detection unit GS that acquires outside information around the vehicle. In this embodiment, the radar GS1 may be provided, for example, on each of the front and rear sides of the straddle type vehicle 1. Alternatively, the sonar GS2 may be provided at each of the front corners of the straddle type vehicle 1 and at each of the rear corners.

(Functional Arrangement of Information Notification Apparatus)

Figure 2:
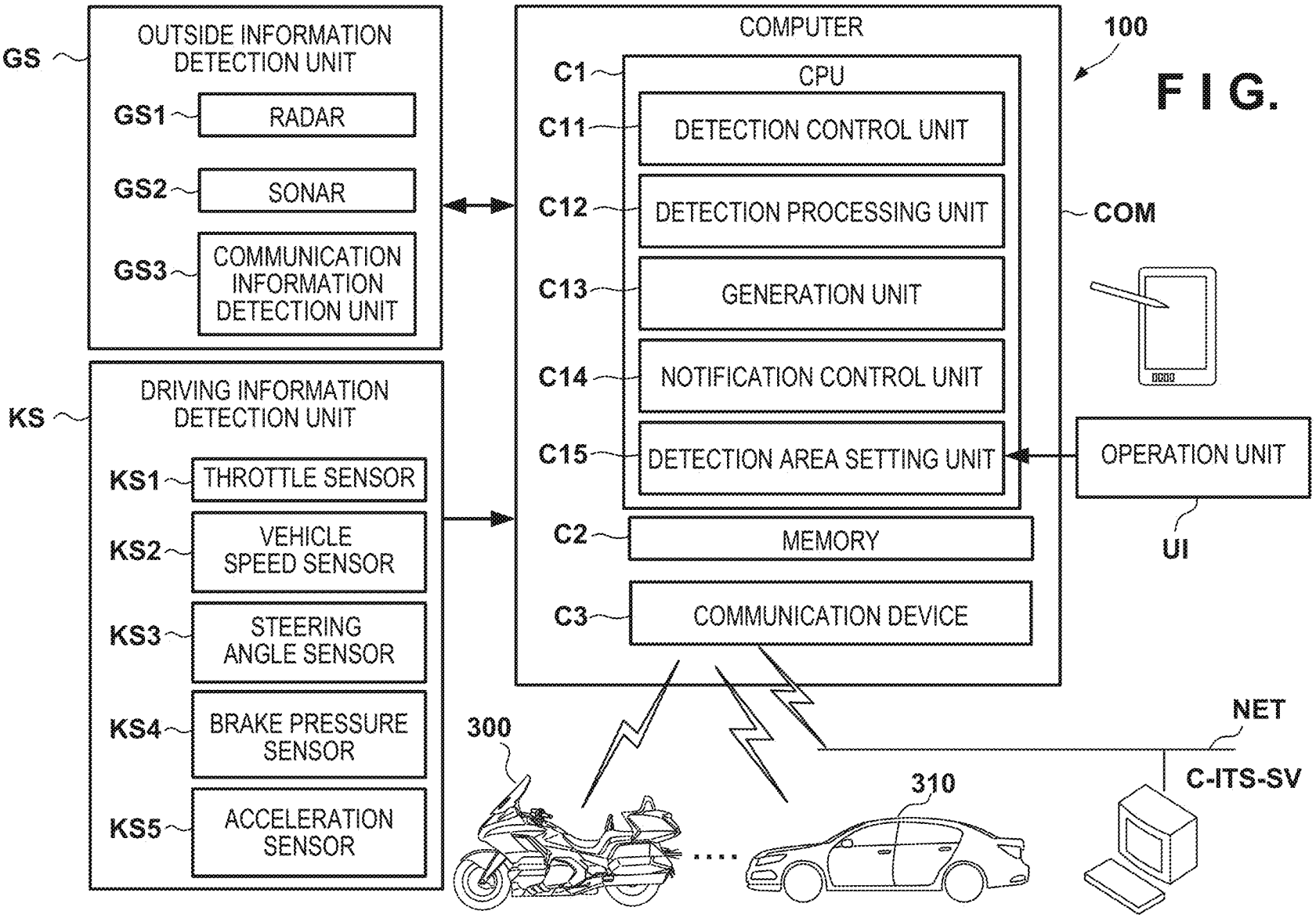
FIG. 2 is a block diagram of the information notification apparatus of a straddle type vehicle according to the embodiment.

FIG. 2 is a block diagram showing the functional arrangement of an information notification apparatus 100 of the straddle type vehicle according to this embodiment. The information notification apparatus 100 is mounted on the straddle type vehicle 1, and can perform information notification mutually with a vehicle existing on the periphery of the straddle type vehicle 1.

The information notification apparatus 100 includes the outside information detection unit GS that acquires outside information around the straddle type vehicle 1, a driving information detection unit KS that acquires information of a driving control system, and a computer COM.

The outside information detection unit GS that acquires outside information around includes the radar GS1, the sonar GS2, and the communication information detection unit GS3 that acquires outside information by communication, and pieces of detection information of the radar GS1, the sonar GS2, and the communication information detection unit GS3 are input to the computer COM.

The radar GS1 is, for example, a millimeter wave radar, which transmits a radio wave and receives the radio wave reflected by an obstacle or a vehicle on the periphery. This makes it possible to detect an obstacle on the front or rear side of the straddle type vehicle 1 or a vehicle on the periphery, and detect the distance (relative distance) to the obstacle or the vehicle on the periphery or the speed (relative speed) of the vehicle on the periphery. Note that radars of different types (different frequency bands) may be used on the front side and the rear side of the straddle type vehicle 1.

The sonar GS2 transmits a sound wave and receives the sound wave reflected by an obstacle or vehicle on the periphery and returned. This makes it possible to detect an obstacle on the front or rear side of the straddle type vehicle 1 or a vehicle on the periphery, and detect the distance (relative distance) to the obstacle or the vehicle on the periphery or the speed (relative speed) of the vehicle on the periphery.

The communication information detection unit GS3 acquires traffic information by communication with a communication server apparatus C-ITS-SV on a network or inter-vehicle communication with a peripheral vehicle, thereby acquiring detection information of an obstacle on the periphery of the straddle type vehicle 1 or a vehicle on the periphery. The communication server apparatus C-ITS-SV can distribute road traffic information collected from infrastructure facilities arranged on a road. Based on the road traffic information distributed from the communication server apparatus C-ITS-SV, the communication information detection unit GS3 can detect the distance (relative distance) to an obstacle on the periphery of the straddle type vehicle 1 or a vehicle on the periphery or the speed (relative speed) of the vehicle on the periphery.

The driving information detection unit KS that acquires information of a driving control system includes, for example, a throttle sensor KS1, a vehicle speed sensor KS2, a steering angle sensor KS3, a brake pressure sensor KS4, an acceleration sensor KS5, and the like, and detection information from each sensor is input to the computer COM.

The computer COM is formed as an electronic control unit (ECU), and includes a CPU (C1) that controls processing associated with driving control of the straddle type vehicle 1, a memory C2, and a communication device C3 that is connected to a network NET, and can communicate with the communication server apparatus C-ITS-SV or vehicles 300, 310, and the like traveling on the periphery of the straddle type vehicle 1 (self-vehicle). The computer COM includes a fuel injection control unit, an ignition control unit, and a throttle control unit, which control the operation of the engine 10.

In addition, the computer COM performs image processing for detection information input from the outside information detection unit GS, extracts an object such as an obstacle existing around the straddle type vehicle 1 or a vehicle traveling on the periphery, and analyzes what kind of object is arranged around the straddle type vehicle 1. For example, it is possible to determine the presence/absence of an obstacle on the front side in a lane where the straddle type vehicle 1 is traveling, a vehicle traveling on the front side of the straddle type vehicle 1, and a vehicle traveling on the rear side in an adjacent lane.

The CPU (C1) of the computer COM executes an information notification program stored in the memory C2, thereby functioning as a detection control unit C11, a detection processing unit C12, a generation unit C13, a notification control unit C14, and a detection area setting unit C15.

The radar GS1, the sonar GS2, and the communication information detection unit GS3 of the outside information detection unit GS have detection areas of different characteristics, and the detection units form a plurality of detection units (GS1,GS2, and GS3) that detect relative information (for example, a relative speed or a relative distance) representing the relative relationship with a vehicle existing on the periphery of the straddle type vehicle 1.

The detection control unit C11 controls switching of a detection unit (detection units) used for information notification in the plurality of detection units (GS1, GS2, and GS3) based on vehicle speed information of the straddle type vehicle detected by the vehicle speed sensor KS2.

Figure 3:
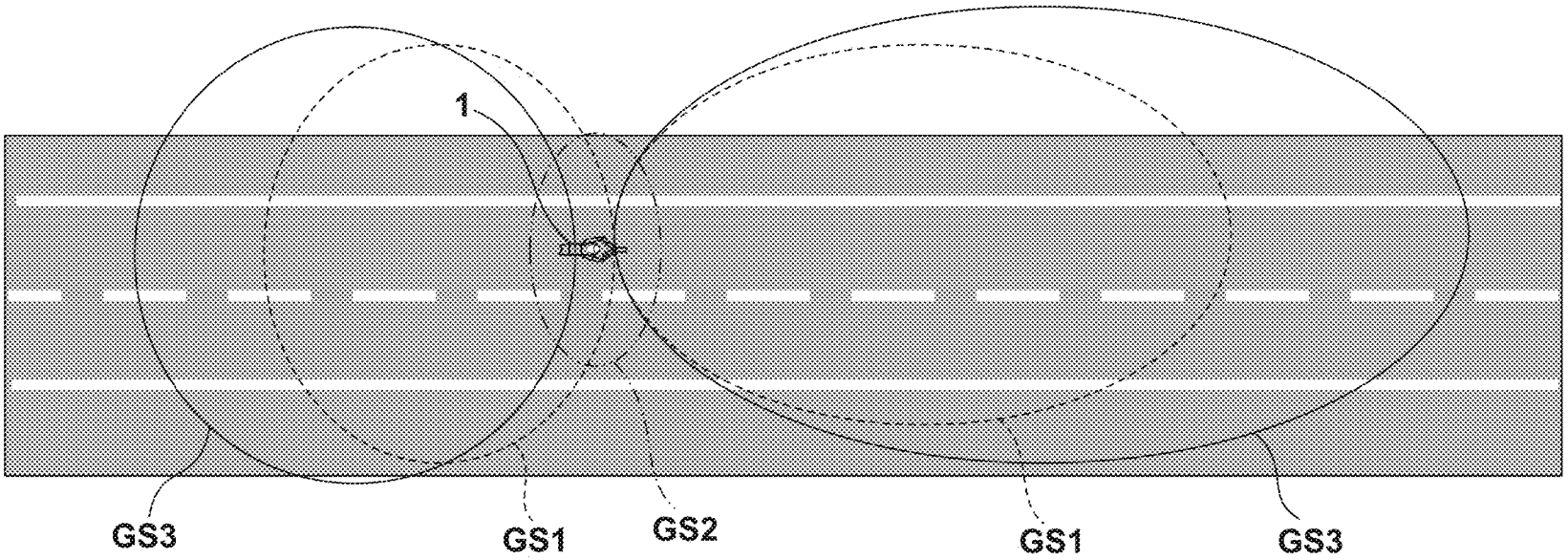
FIG. 3 is a view showing the detection areas of a plurality of detection units having detection areas of different characteristics.

FIG. 3 is a view showing the detection areas of the plurality of detection units (the radar GS1, the sonar GS2, and the communication information detection unit GS3) having detection areas of different characteristics. Of the three detection units, the communication information detection unit GS3 has a long detection distance and a wide detection area where detection can be performed up to the farthest point.

The sonar GS2 has the narrowest detection area in the three detection units. The detection distance of the radar GS1 is longer than the detection distance of the sonar GS2 and shorter than the detection distance of the communication information detection unit GS3. The detection area of the radar GS1 is wider than the detection area of the sonar GS2 and narrower than the detection area of the communication information detection unit GS3.

(Procedure of Information Notification Processing)

Figure 4:
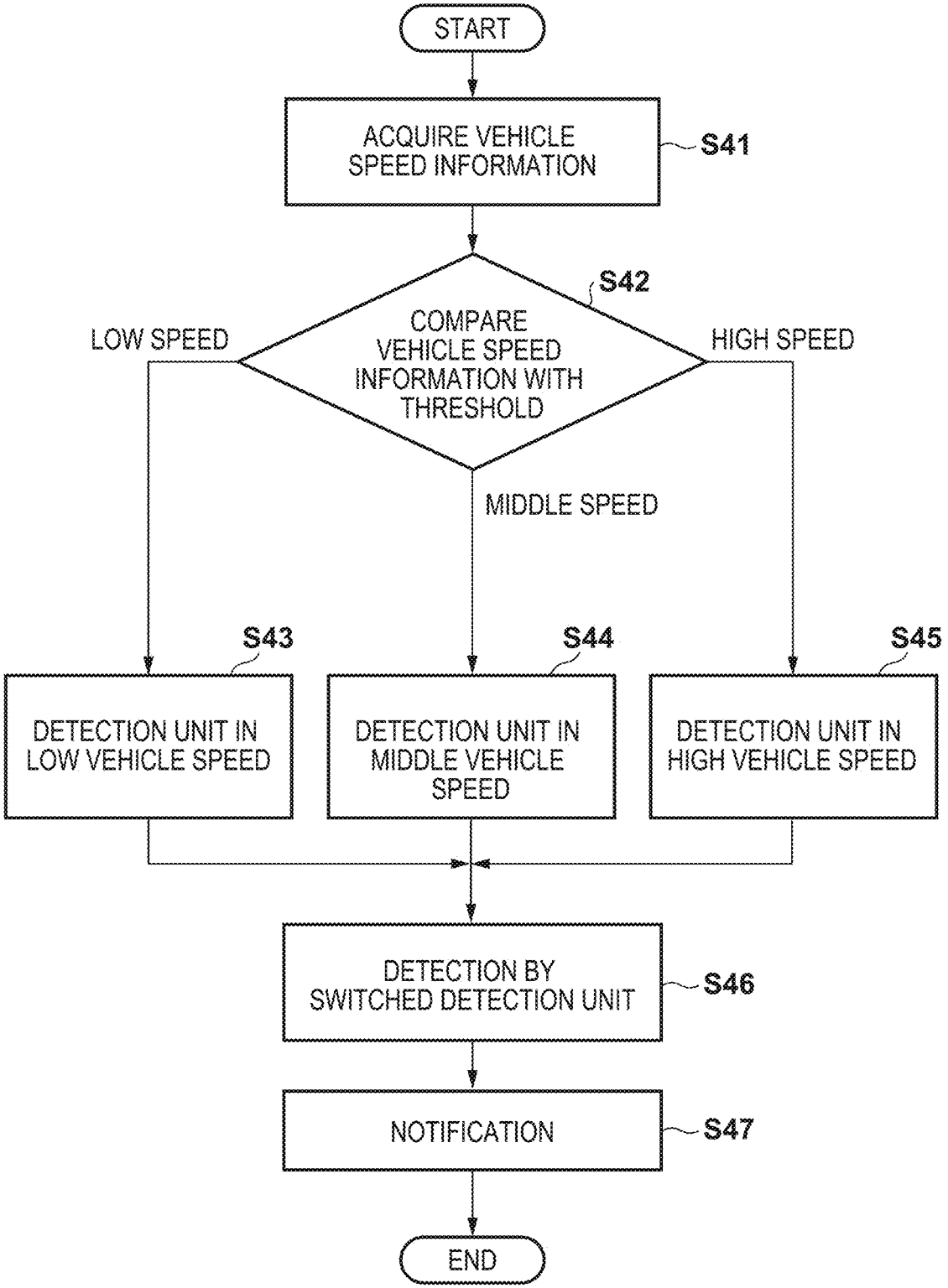
FIG. 4 is a flowchart for explaining the procedure of processing of a detection control unit and a notification control unit.

FIG. 4 is a flowchart for explaining the procedure of information notification processing of the detection control unit C11 and the notification control unit C14. In step S41, the vehicle speed sensor KS2 detects the vehicle speed information of the straddle type vehicle 1 and inputs it to the computer COM.

In step S42, the detection control unit C11 compares the vehicle speed information input from the vehicle speed sensor KS2 with threshold speeds (a first threshold speed and a second threshold speed) stored in the memory C2. As for the relationship between the first threshold speed and the second threshold speed, the first threshold speed is a threshold of a speed lower than the second threshold speed.

In this embodiment, the vehicle speed information is compared with two threshold speeds. However, the present invention is not limited to this example, and one threshold speed serving as a reference and the vehicle speed information may be compared. Alternatively, comparison processing may be performed by setting three or more threshold speeds. In this embodiment, the vehicle speed information and the threshold speeds are compared. Instead, the relative speed between the straddle type vehicle 1 and a specific peripheral vehicle may be acquired in step S41, and the relative speed and the threshold speeds may be compared in this step.

If the vehicle speed information input from the vehicle speed sensor KS2 is equal to or lower than the first threshold speed, the detection control unit C11 determines that the straddle type vehicle 1 is in a low speed traveling state, and advances the process to step S43. In step S43, the detection control unit C11 switches the detection unit (detection units) used for information notification in the plurality of detection units (the radar GS1, the sonar GS2, and the communication information detection unit GS3) to the detection unit in low vehicle speed traveling. As the detection unit in low vehicle speed traveling, the detection control unit C11 can switch the detection units to, for example, the combination of the sonar GS2 and the radar GS1.

On the other hand, in step S42, if the vehicle speed information input from the vehicle speed sensor KS2 is higher than the first threshold speed and equal to or lower than the second threshold speed, the detection control unit C11 determines that the straddle type vehicle 1 is in a middle speed traveling state, and advances the process to step S44. In step S44, the detection control unit C11 switches the detection units used for information notification in the plurality of detection units (the radar GS1, the sonar GS2, and the communication information detection unit GS3) to the detection unit in middle vehicle speed traveling. As the detection unit in middle vehicle speed traveling, the detection control unit C11 can switch the detection units to, for example, the combination of the radar GS1 and the communication information detection unit GS3.

In the determination of step S42, if the vehicle speed information input from the vehicle speed sensor KS2 is higher than the second threshold speed, the detection control unit C11 determines that the straddle type vehicle 1 is in a high speed traveling state, and advances the process to step S45. In step S45, the detection control unit C11 switches detection units used for information notification in the plurality of detection units (the radar GS1, the sonar GS2, and the communication information detection unit GS3) to the detection units in high vehicle speed traveling. As the detection units in high vehicle speed traveling, the detection control unit C11 can switch the detection units to, for example, the combination of the communication information detection unit GS3 and the radar GS1, the combination of the communication information detection unit GS3 and the sonar GS2, or the combination of the communication information detection unit GS3, the radar GS1, and the sonar GS2. When a plurality of detections having different detection areas are used, information notification using the characteristic of each detection unit can be performed.

In step S46, the detection processing unit C12 detects a vehicle existing on the periphery of the straddle type vehicle based on the information of the detection units switched by the detection control unit C11.

In step S47, the notification control unit C14 performs information notification based on the detection result of the switched detection units. The communication device C3 communicates with the vehicle detected based on the information of the switched detection units. The communication may be direct inter-vehicle communication or may be communication via the communication server apparatus (C-ITS-SV).

Triggered by establishment of communication with the vehicle detected based on the information of the switched detection units, the generation unit C13 generates existence information representing the existence of the vehicle and existence information representing the existence of the straddle type vehicle 1.

The information notification apparatus 100 can perform notification (information notification) of existence information representing existence mutually with a vehicle existing on the periphery of the straddle type vehicle 1 and the notification control unit C14 notifies the driver of the straddle type vehicle 1 of the existence information representing the existence of the vehicle. In addition, the notification control unit C14 notifies the vehicle existing on the periphery of the straddle type vehicle 1 of the existence information representing the existence of the straddle type vehicle 1 via the communication device C3.

(Detailed Example of Notification of Existence Information)

Figure 5:
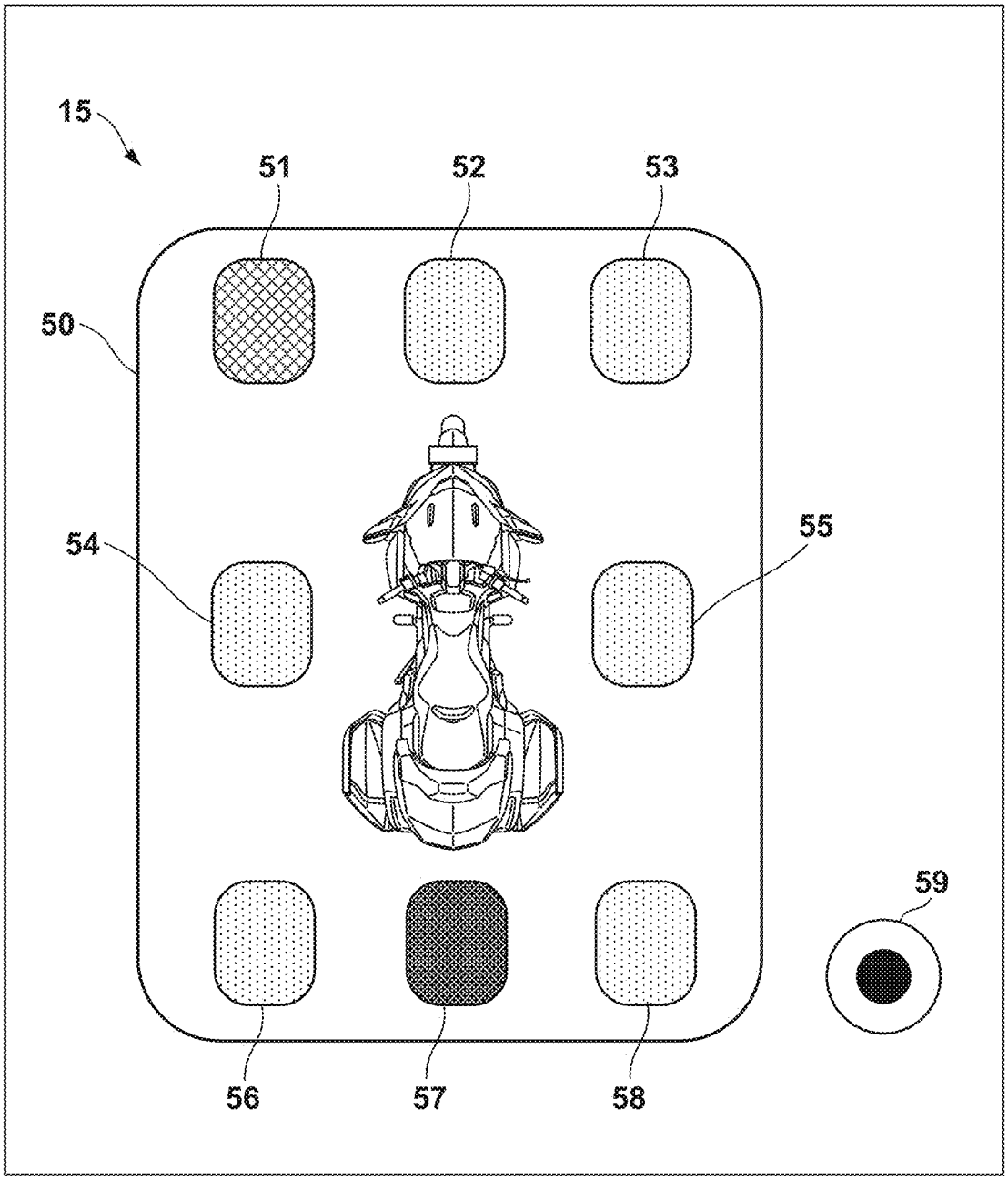
FIG. 5 is a view showing a notification of existence information by the notification control unit.

FIG. 5 is a view showing a notification of existence information by the notification control unit C14. The notification control unit C14 performs notification display of existence information representing the existence of a vehicle in accordance with the relative information to a vehicle detected based on the information of the switched detection units. The display device 15 includes a notification display unit 50 that notifies the driver of the existence information representing the existence of the vehicle detected by the switched detection units. The notification control unit C14 performs display control of changing the notification display on the notification display unit 50 in accordance with the relative information (for example, the relative distance or relative speed).

The straddle type vehicle 1 that is the self-vehicle is displayed on the notification display unit 50, and indicators 51 to 58 for notification are arranged around the straddle type vehicle 1. The notification control unit C14 changes the display colors of the indicators 51 to 58 in accordance with the relative information (for example, the relative distance or relative speed) between a vehicle and the straddle type vehicle 1, thereby notifying the driver of the existence information of the vehicle existing on the periphery of the straddle type vehicle 1.

The indicators 51 and 53 notify the existence of a vehicle existing diagonally on the front side of the straddle type vehicle 1, and the indicator 52 notifies the existence of a vehicle existing on the front side of the straddle type vehicle 1. The indicators 54 and 55 notify the existence of a vehicle existing on a lateral side of the straddle type vehicle 1. The indicators 56 and 58 notify the existence of a vehicle existing diagonally on the rear side of the straddle type vehicle 1, and the indicator 57 notifies the existence of a vehicle existing on the rear side of the straddle type vehicle 1.

For example, if the relative distance between a vehicle and the straddle type vehicle 1 is sufficiently long, the notification control unit C14 displays an indicator for a corresponding direction in "green" representing that the relative distance is sufficiently long. If the relative distance between a vehicle and the straddle type vehicle 1 is a predetermined distance but needs caution, the notification control unit C14 displays an indicator for a corresponding direction in "yellow" representing caution. If the relative distance between a vehicle and the straddle type vehicle 1 is an approaching distance less than a predetermined distance, the notification control unit C14 displays an indicator for a corresponding direction in "red" representing approach, thereby notifying the driver of the existence information of the vehicle existing on the periphery of the straddle type vehicle 1.

If the relative distance between a vehicle on the periphery and the straddle type vehicle 1 (self-vehicle) is a sufficiently long distance, the notification control unit C14 performs display control to display each indicator in "green". If the relative distance to a vehicle diagonally on the front left side becomes short to a distance that needs caution, the notification control unit C14 performs display control to display the indicator 51 corresponding to the diagonal left front in "yellow". If the relative distance to a vehicle on the rear side becomes less than a predetermined distance, the notification control unit C14 performs display control to display the indicator 57 corresponding to the rear side in "red".

It is possible to effectively notify the driver of the existence information by changing the notification of the existence information stepwise in accordance with the relative information (the relative distance or the relative speed). Referring to FIG. 5, the display device 15 is provided with an operation unit 59 (operation button) that switches ON/OFF of notification display. If the operation unit 59 is in an ON state, the notification control unit C14 causes the notification display unit 50 of the display device 15 to display notification display. For example, if the operation unit 59 (operation button) is pressed by the driver, and the operation unit 59 changes to the ON state, the notification control unit C14 causes the notification display unit 50 of the display device 15 to display notification display (FIG. 5). If the operation unit 59 is in an OFF state, the notification control unit C14 controls display of the display device 15 not to display notification display. For example, if the operation unit 59 (operation button) is pressed again, the operation unit 59 is switched for the ON state to the OFF state, and the notification control unit C14 controls display of the display device 15 not to display notification display in FIG. 5.

In addition, at least one of the tail turn signal 16 and the tail light 17 of the straddle type vehicle 1 is provided with notification display units 18 and 19 that notify a vehicle existing on the periphery of the existence information representing the existence of the straddle type vehicle. The notification control unit C14 performs display control of changing notification display on the notification display units 18 and 19 in accordance with relative information. The notification control unit C14 can, for example, control the display colors of the notification display units 18 and 19 as in the display control of the indicators 51 to 58. This makes it possible to efficiently notify a vehicle existing on the periphery of the straddle type vehicle 1 (self-vehicle) of the existence of the self-vehicle and avoid in advance an approaching state of the straddle type vehicle 1 and the vehicle existing on the periphery. It is therefore possible to perform acquisition of a traffic situation and information notification without any cumbersome operation and reduce the burden on the driver.

Referring back to FIG. 4, in step S47, if the detected vehicle speed information has not changed, the notification control unit C14 continuously performs notification display. If the vehicle speed information has changed, the notification control unit C14 returns the process to step S42, and repeat similar processing.

According to this embodiment, it is possible to control switching of the detection unit (detection units) used for information notification in the plurality of detection units based on the vehicle speed information of the straddle type vehicle 1. By switching to the detection unit (detection units) suitable for the traveling state based on vehicle speed information, notification information can be provided to the driver. It is therefore possible to perform acquisition of a traffic situation and information notification without any cumbersome operation and reduce the burden on the driver.

(User Setting of Detection Area)

User setting of the detection area will be described next. The plurality of detection units (the radar GS1, the sonar GS2, and the communication information detection unit GS3) have detection areas of different characteristics, as shown in FIG. 3. The driver who is the user can change the setting of the detection area by input from an information terminal device, for example, an operation unit UI (FIG. 2) such as a smartphone or a tablet terminal.

The operation unit UI functions as a user interface and accepts a detection area change operation by the user. If a detection area change operation is input, the detection area setting unit C15 sets the detection areas of the detection units based on the input from the operation unit UI.

Figure 6:
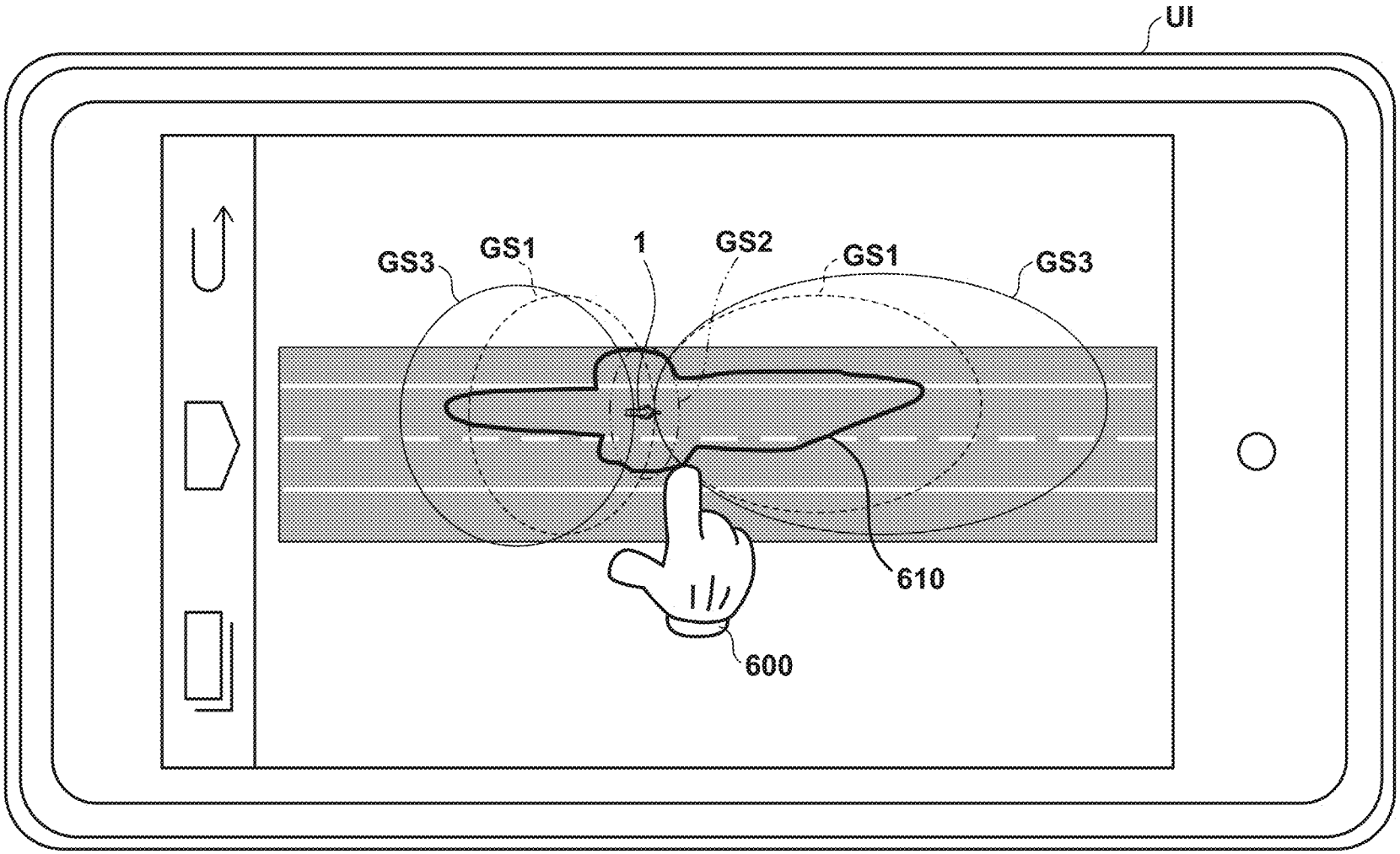
FIG. 6 is a view showing an example of setting of detection areas based on input from an information terminal device.

FIG. 6 is a view showing an example of setting of detection areas based on input from the operation unit UI. In the screen of the operation unit UI, the detection areas of the plurality of detection units (the radar GS1, the sonar GS2, and the communication information detection unit GS3) with respect to the straddle type vehicle 1 (self-vehicle) as the center are displayed. For example, when a user 600 performs a change operation by tracing the screen of the operation unit UI by a finger, the detection area setting unit C15 sets a detection area 610 based on the change operation. The change operation may be done using an input device such as a touch pen. In the example of the change operation of the detection area 610 shown in FIG. 6, a detection area long along the traveling direction and an area wide to the left and right lateral sides on the periphery close to the straddle type vehicle 1 (self-vehicle) are designated. The detection area setting unit C15 obtains the coordinate information of the set detection area 610, and changes the detection area in accordance with the vehicle speed.

Figure 7:
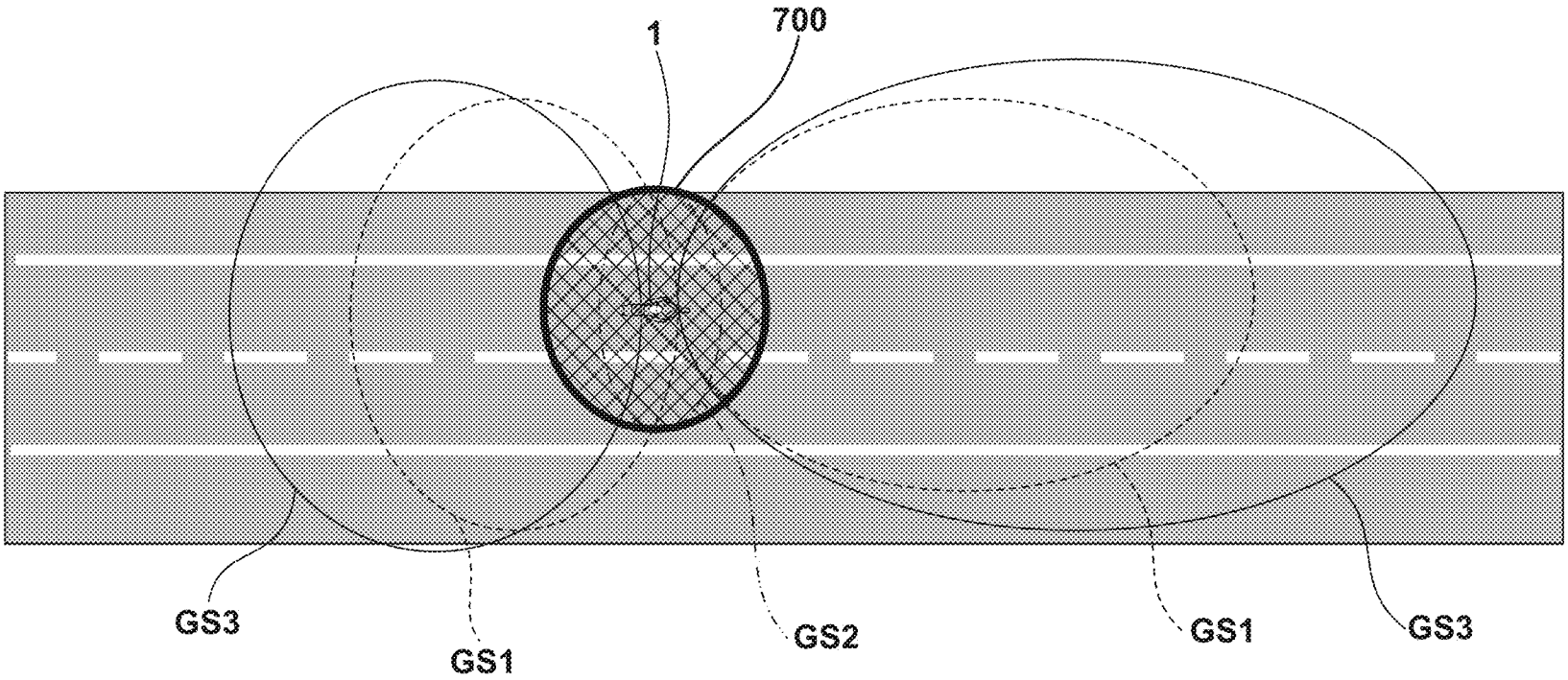
FIG. 7 is a view showing an example of change of detection areas in low vehicle speed traveling.
Figure 8:
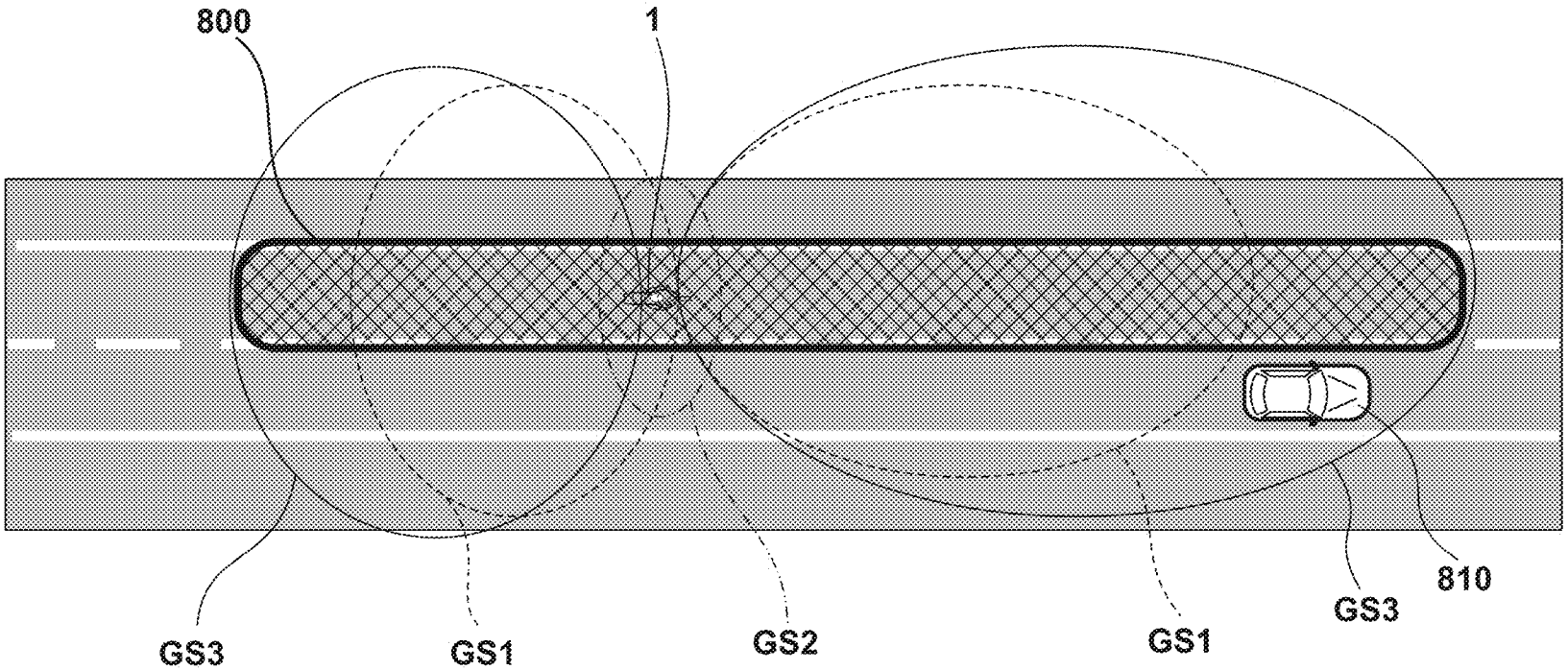
FIG. 8 is a view showing an example of change of detection areas in high vehicle speed traveling.

FIG. 7 is a view showing an example of change of detection areas in low vehicle speed traveling. In low vehicle speed traveling, the detection area setting unit C15 sets a detection area 700 including the areas on the left and right lateral sides of the straddle type vehicle 1 (self-vehicle) based on the detection area designated by the change operation of the user 600. FIG. 8 is a view showing an example of change of detection areas in high vehicle speed traveling. In high vehicle speed traveling, the detection area setting unit C15 sets a detection area 800 including the long area along the traveling direction based on the detection area designated by the change operation of the user 600.

The notification control unit C14 changes the detection area of the detection unit switched based on vehicle speed information to the detection area whose setting is changed by the detection area setting unit C15, and performs notification display of existence information representing the existence of a vehicle in accordance with the relative information to a vehicle detected in the detection area whose setting is changed. When the detection area is set by the detection area setting unit C15, detection of a vehicle or an obstacle as a notification target is done only in the detection area whose setting is changed. For example, in FIG. 8, before the setting change of the detection area, a vehicle 810 traveling in the detection area of the communication information detection unit GS3 is detected. If the setting of the detection area is changed, since detection of a vehicle or the like as a notification target is limited to an object existing in the detection area 800 whose setting is changed, the vehicle 810 outside the detection area 800 is not a notification target.

When the setting of the detection area can be changed in accordance with a peripheral environment characteristic unique to the user, such as a riding scene, place, time, and weather, it is possible to perform acquisition of a traffic situation and information notification with focus on a place where the user wants to ride with caution without any cumbersome operation and reduce the burden on the driver.

Summary of Embodiment

Arrangement 1. An information notification apparatus according to the above-described embodiment is an information notification apparatus (for example, 100) mounted on a straddle type vehicle (for example, 1) and capable of performing information notification mutually with a vehicle existing on the periphery of the straddle type vehicle, comprising:

a plurality of detection units (for example, GS1, GS2, GS3), having detection areas of different characteristics, configured to detect relative information representing a relative relationship with the vehicle;

a detection control unit (for example, C11) configured to control, based on vehicle speed information of the straddle type vehicle (1), switching of detection units used for the information notification in the plurality of detection units (GS1, GS2, GS3); and a display unit (15), including a notification display unit (50), configured to notify a driver of existence information representing existence of the vehicle in a detection area.

According to the information notification apparatus of Arrangement 1, it is possible to control switching of the detection unit (detection units) used for information notification in the plurality of detection units based on the vehicle speed information of the straddle type vehicle. Additionally, by switching to the detection unit (detection units) suitable for the traveling state based on vehicle speed information, it is possible to perform acquisition of a traffic situation and information notification without any cumbersome operation and reduce the burden on the driver.

Arrangement 2. The information notification apparatus (100) according to the above-described embodiment further comprises:

a detection processing unit (for example, C12) configured to detect a vehicle existing on the periphery of the straddle type vehicle (1) based on information of the detection units switched by the detection control unit (C11);

a communication unit (for example, C3) configured to communicate with the detected vehicle;

a generation unit (for example, C13), triggered by establishment of communication with the vehicle, configured to generate existence information representing existence of the vehicle and existence information representing existence of the straddle type vehicle; and a notification control unit (for example, C14) configured to notify a driver of the straddle type vehicle of the existence information representing the existence of the vehicle, wherein the notification control unit (C14) notifies the vehicle existing on the periphery of the straddle type vehicle of the existence information representing the existence of the straddle type vehicle via the communication unit (C3).

According to the information notification apparatus of Arrangement 2, notification information can be shared by mutually notifying the existence information with the vehicle exiting on the periphery of the straddle type vehicle. It is therefore possible to perform acquisition of a traffic situation on the periphery of the straddle type vehicle and information notification between the vehicles without any cumbersome operation and reduce the burden on the driver.

Arrangement 3. The information notification apparatus (100) according to the above-described embodiment, wherein the notification control unit (C14) performs display control of changing notification display on the notification display unit (50) in accordance with the relative information.

According to the information notification apparatus of Arrangement 3, it is possible to effectively notify the driver of the existence information by changing the notification of the existence information in accordance with the relative information (a relative distance or a relative speed).

Arrangement 4. The information notification apparatus (100) according to the above-described embodiment further comprises a detection area setting unit (for example, C15) configured to set the detection area based on input from an information terminal device (for example, UI), wherein the detection control unit (C11) controls switching of the detection units based on the set detection area.

According to the information notification apparatus of Arrangement 4, when the setting of the detection area can be changed in accordance with a characteristic unique to the user, such as a riding scene, place, time, and weather, it is possible to perform acquisition of a traffic situation and information notification with focus on a place where the user wants to ride with caution without any cumbersome operation and reduce the burden on the driver.

Arrangement 5. In the information notification apparatus (100) according to the above-described embodiment, at least one of a tail turn signal (for example, 16) and a tail light (for example, 17) of the straddle type vehicle (1) is provided with a notification display unit (for example, 18, 19) configured to notify the vehicle of the existence information representing the existence of the straddle type vehicle (1).

Arrangement 6. In the information notification apparatus (100) according to the above-described embodiment, the notification control unit (C14) performs display control of changing notification display on the notification display unit (18, 19) in accordance with the relative information.

According to the information notification apparatus of Arrangement 5 or 6, it is possible to efficiently notify the vehicle existing on the periphery of the straddle type vehicle 1 (self-vehicle) of the existence of the self-vehicle and avoid in advance an approaching state of the vehicles. It is therefore possible to perform acquisition of a traffic situation and information notification without any cumbersome operation and reduce the burden on the driver.

Arrangement 7. In the information notification apparatus (100) according to the above-described embodiment, the display unit (15) is provided with an operation unit (for example, 59) configured to switch ON/OFF of the notification display, and the notification control unit (C14)

causes the notification display unit (50) of the display unit (15) to display notification display if an operation input of the operation unit (59) is in an ON state, and controls display of the notification display unit (50) not to display the notification display if the operation input of the operation unit (59) is in an OFF state.

According to the information notification apparatus of Arrangement 7, ON/OFF of the notification display can be switched by the operation input of the driver. It is possible to control notification display in accordance with the requirement of the driver such that, for example, the notification display is turned on in a traveling section where the driver takes caution, and the notification display is turned off in an accustomed traveling section.

Arrangement 8. In the information notification apparatus (100) according to the above-described embodiment, the detection units used for the information notification in the plurality of detection units (GS1, GS2, GS3) include a combination of at least two of a radar (for example, GS1), a sonar (for example, GS2), and a communication information detection unit (for example, GS3) configured to acquire outside information by communication.

According to the information notification apparatus of Arrangement 8, when a plurality of detections having different detection areas are used, information notification using the characteristic of each detection unit can be performed.

Arrangement 9. A straddle type vehicle (for example, 1) according to the above-described embodiment comprises an information notification apparatus (100) described in any one of Arrangements 1 to 8.

According to the straddle type vehicle of Arrangement 9, it is possible to provide a straddle type vehicle capable of controlling switching of the detection unit (detection units) used for information notification in the plurality of detection units based on the vehicle speed information of the straddle type vehicle. Additionally, by switching to the detection unit (detection units) suitable for the traveling state based on vehicle speed information, it is possible to perform acquisition of a traffic situation and information notification based on the traveling state without any cumbersome operation and reduce the burden on the driver.

Arrangement 10. An information notification method according to the above-described embodiment is an information notification method in an information notification apparatus (for example, 100) mounted on a straddle type vehicle (1), capable of performing information notification mutually with a vehicle existing on the periphery of the straddle type vehicle, the method comprising:

a detection step of detecting, by a plurality of detection units (GS1, GS2, GS3) having detection areas of different characteristics set based on input from an information terminal device (UI), relative information representing a relative relationship with the vehicle;

a detection control step (S42, S43, S44, S45) of controlling, based on vehicle speed information of the straddle type vehicle, switching of detection units used for the information notification in the plurality of detection units; and a notification step (S47) of notifying, by a display unit (15) including a notification display unit (50), a driver of existence information representing existence of the vehicle in a detection area.

According to the information notification method of Arrangement 10, it is possible to control switching of the detection unit (detection units) used for information notification in the plurality of detection units based on the vehicle speed information of the straddle type vehicle. Additionally, by switching to the detection unit (detection units) suitable for the traveling state based on vehicle speed information, it is possible to perform acquisition of a traffic situation and information notification based on the traveling state without any cumbersome operation and reduce the burden on the driver.

Arrangement 11. The information notification method according to the above-described embodiment further comprises: a detection processing step (S46) of detecting a vehicle existing on the periphery of the straddle type vehicle based on information of the detection units switched in the detection control step;

a communication step (S47) of communicating with the detected vehicle by a communication unit;

a generation step (S47) of, triggered by establishment of communication with the vehicle, generating existence information representing existence of the vehicle and existence information representing existence of the straddle type vehicle; and a notification control step (S47) of notifying a driver of the straddle type vehicle of the existence information representing the existence of the vehicle, wherein in the notification control step (S47), the vehicle existing on the periphery of the straddle type vehicle is notified of the existence information representing the existence of the straddle type vehicle via the communication unit.

According to the information notification method of Arrangement 11, notification information can be shared by mutually notifying the existence information with the vehicle exiting on the periphery of the straddle type vehicle. It is therefore possible to perform acquisition of a traffic situation on the periphery of the straddle type vehicle and information notification between the vehicles without any cumbersome operation and reduce the burden on the driver.

The present invention is not limited to the above embodiments and various changes and modifications can be made within the spirit and scope of the present invention. Therefore, to apprise the public of the scope of the present invention, the following claims are made.

What is claimed is:

1. An information notification apparatus mounted on a straddle type vehicle and capable of performing information notification mutually with a vehicle existing on a periphery of the straddle type vehicle, comprising:

a plurality of detection units configured to detect relative information representing a relative relationship with the vehicle;

a detection control unit configured to control, based on vehicle speed information of the straddle type vehicle, switching of detection units used for the information notification in the plurality of detection units;

wherein one of the plurality of detection units is capable of setting a plurality of detection areas of different characteristics;

the plurality of detection areas of different characteristics are capable of being set based on input from an information terminal device;

a detection processing unit configured to detect the vehicle existing on the periphery of the straddle type vehicle based on information of the detection units switched by the detection control units;

a communication unit configured to communicate with the detected vehicle;

a generation unit, triggered by establishment of communication with the vehicle, configured to generate existence information representing existence of the vehicle and existence information representing existence of the straddle type vehicle; and a notification control unit configured to notify a driver of the straddle type vehicle of the existence information representing the existence of the vehicle, wherein the notification control unit notifies the vehicle existing on the periphery of the straddle type vehicle of the existence information representing the existence of the straddle type vehicle via the communication unit, and a display unit, including a notification display unit, configured to notify a driver of existence information representing existence of the vehicle in one of the detection areas.

2. The information notification apparatus according to claim 1, wherein the notification control unit performs display control of changing notification display on the notification display unit in accordance with the relative information.

3. The information notification apparatus according to claim 1, further comprising a detection area setting unit configured to set the detection area based on input from the information terminal device, wherein the detection control unit controls switching of the detection units based on the set detection area.

4. The information notification apparatus according to claim 1, wherein at least one of a tail turn signal and a tail light of the straddle type vehicle is provided with a notification display unit configured to notify the vehicle of the existence information representing the existence of the straddle type vehicle.

5. The information notification apparatus according to claim 4, wherein the notification control unit performs display control of changing notification display on the notification display unit in accordance with the relative information.

6. The information notification apparatus according to claim 2, wherein the display unit is provided with an operation unit configured to switch ON/OFF of the notification display, and the notification control unit causes the notification display unit of the display unit to display notification display if an operation input of the operation unit is in an ON state, and controls display of the notification display unit not to display the notification display if the operation input of the operation unit is in an OFF state.

7. The information notification apparatus according to claim 1, wherein the detection units used for the information notification in the plurality of detection units include a combination of at least two of a radar, a sonar, and a communication information detection unit configured to acquire outside information by communication.

8. The information notification apparatus according to claim 1, wherein the information terminal device is a terminal configured to accept directly an input from an operator.

9. A straddle type vehicle on which an information notification apparatus is mounted, wherein the information notification apparatus is capable of performing information notification mutually with a vehicle existing on a periphery of the straddle type vehicle, wherein the information notification apparatus, comprises:

a plurality of detection units configured to detect relative information representing a relative relationship with the vehicle;

a detection control unit configured to control, based on vehicle speed information of the straddle type vehicle, switching of detection units used for the information notification in the plurality of detection units;

wherein one of the plurality of detection units is capable of setting a plurality of detection areas of different characteristics;

the plurality of detection areas of different characteristics are capable of being set based on input from an information terminal device;

a detection processing unit configured to detect the vehicle existing on the periphery of the straddle type vehicle based on information of the detection units switched by the detection control units;

a communication unit configured to communicate with the detected vehicle;

a generation unit, triggered by establishment of communication with the vehicle, configured to generate existence information representing existence of the vehicle and existence information representing existence of the straddle type vehicle; and a notification control unit configured to notify a driver of the straddle type vehicle of the existence information representing the existence of the vehicle, wherein the notification control unit notifies the vehicle existing on the periphery of the straddle type vehicle of the existence information representing the existence of the straddle type vehicle via the communication unit, and a display unit, including a notification display unit, configured to notify a driver of existence information representing existence of the vehicle in one of the detection areas.

10. An information notification method in an information notification apparatus mounted on a straddle type vehicle capable of performing information notification mutually with a vehicle existing on a periphery of the straddle type vehicle, the method comprising:

a detection step of detecting, by a plurality of detection units, relative information representing a relative relationship with the vehicle;

a detection control step of controlling, based on vehicle speed information of the straddle type vehicle, switching of detection units used for the information notification in the plurality of detection units;

wherein one of the plurality of detection units is capable of setting a plurality of detection areas of different characteristics;

the plurality of detection areas of different characteristics are capable of being set based on input from an information terminal device; and a detection processing step of detecting the vehicle existing on the periphery of the straddle type vehicle based on information of the detection units switched in the detection control step;

a communication step of communicating with the detected vehicle by a communication unit;

a generation step of, triggered by establishment of communication with the vehicle, generating existence information representing existence of the vehicle and existence information representing existence of the straddle type vehicle; and a notification control step of notifying a driver of the straddle type vehicle of the existence information representing the existence of the vehicle, wherein in the notification control step, the vehicle existing on the periphery of the straddle type vehicle is notified of the existence information representing the existence of the straddle type vehicle via the communication unit, and a notification step of notifying, by a display unit including a notification display unit, a driver of existence information representing existence of the vehicle in one of the detection areas.

* * * * *